United States Patent [19]

Hupp

[11] 3,998,152

[45] Dec. 21, 1976

[54] PROTECTION SYSTEM FOR HAMMER DRIVE CIRCUITS IN IMPACT PRINTERS

[75] Inventor: Arthur C. Hupp, Lyndhurst, Va.

[73] Assignee: General Electric Company, Waynesboro, Va.

[22] Filed: Mar. 26, 1975

[21] Appl. No.: 562,105

[52] U.S. Cl. ..... 101/93.29; 317/33 SC; 235/153 AS

[51] Int. Cl.[2] ..... B41J 9/38

[58] Field of Search ..... 101/93.13–93.14, 101/93.29–93.34; 340/172.5; 317/33 SC, 27 R, 31; 235/153 A, 153 AS

[56] References Cited

UNITED STATES PATENTS

| | | | |
|---|---|---|---|
| 3,140,470 | 7/1964 | Deerfield | 235/153 AS X |
| 3,539,786 | 11/1970 | Raehpour | 235/153 AS |
| 3,602,138 | 8/1975 | Barcomb | 101/93.14 |
| 3,699,884 | 10/1972 | Marsh et al. | 101/93.14 |
| 3,796,918 | 3/1974 | DeForest et al. | 317/33 SC X |
| 3,813,530 | 5/1974 | Chevalier et al. | 235/153 A |
| 3,842,317 | 10/1974 | Mattes et al. | 317/33 SC |

*Primary Examiner*—Edward M. Coven
*Attorney, Agent, or Firm*—Michael Masnik

[57] ABSTRACT

An arrangement for protecting hammer drive solenoids in a printer against failure in associated SCR circuits by correlating the currents of SCR gate firing pulses with subsequent SCR conduction.

8 Claims, 3 Drawing Figures

PROTECTION SYSTEM FOR HAMMER DRIVE CIRCUITS IN IMPACT PRINTERS

BACKGROUND OF THE INVENTION

The present invention relates to electronic impact printers and more particularly to methods and means for protecting the hammer drive circuits used in effecting printing.

Printers exist today wherein a full line of input data characters are stored in memory, then processed sequentially before a plurality of such stored input data characters are printed along a line on a record medium. Printing takes place by the operation of hammers which cause type characters to impact the record medium. The number of hammers involved may number well over 100. Generally speaking, there is associated with each hammer a solenoid which is selectively energized at the appropriate time to cause hammer actuation to take place. For further details of the type of printer arrangement involved, reference may be made to U.S. Pat. No. 3,803,558 issued Apr. 9, 1974 to Clifford M. Jones et al entitled "Print Selection System". Reference may also be made to U.S. Pat. No. 3,605,610 issued on Sept. 20, 1971 to Earle B. McDowell et al entitled "Type Member Position Sensing System in a High Speed Printer". This latter patent describes the details of a hammer drive circuitry for use with a belt printer. A belt printer comprises a continuously moving character belt that carries the type faces for each character to be printed. The number of type faces carried on the belt depends upon the number of characters or symbols the apparatus is to be capable of printing. A plurality of hammers are arranged in a row across the face of a record medium such as paper, the position of each hammer establishing a column in which a character may be printed. An inking ribbon is positioned in front of the record medium and the path of the character belt is located behind the inking ribbon and in front of the hammers. Means are provided for discretely indicating the control circuitry where each character appears relative to the record medium. When this is known, circuitry is provided for energizing the hammers at an appropriate position to imprint the appropriate characters in any desired position. A common type of hammer firing circuit employs SCR's in series with respective hammer solenoids. At an appropriate time the SCR is gated on, thereby energizing the associated solenoid and causing the respective hammer to actuate the type character on the belt located at the column location associated with the particular hammer. Where hammers number in the order of 100 or more, it is apparent that a substantial amount of power is involved to enable simultaneous energization of a plurality of solenoids and hence simultaneous printing at various column locations on the record medium. The nature of the printing is such that extremely high currents must be delivered to the solenoids to cause swift hammer actuation as well as to drive the hammer with sufficient force to cause impact printing on the record medium including multiple copies thereof. The solenoid coils can withstand this high power application intermittently but not continuously. The nature of line printing or partial line printing is such that printing and hence solenoid operation does not occur continuously. However, difficulties arise with respect to the power application circuits associated with each solenoid, particularly where silicon controlled rectifiers (SCR's) are employed. Some SCR's may fail during operation by being unable to withstand a forward voltage or because of short circuiting in the SCR itself. In either case, control of SCR operation by a gate control signal is lost, giving the effect of a continuously closed switch resulting in overloading of the hammer solenoid.

Efforts to protect against SCR malfunction and prevent solenoid burn-up heretofore have been relatively unsuccessful or unreliable particularly at higher printing rates. Sometimes, monitoring the average hammer drive current at low printing rates is possible when the average current attributable to an SCR failure is greater than the total average hammer drive current associated with relatively low printing rates. However, when the printing rates result in an average current being supplied to the hammer solenoids which is greater than that due to the failure of one SCR circuit, this approach is impractical.

Accordingly, one object of this invention is to provide an improved apparatus for detecting SCR failure in a hammer drive circuit for a high speed line printer.

Another object of this invention is to provide an improved method and apparatus for protecting hammer drive solenoids against malfunctions in the switching circuits employed for applying power to the solenoids.

Another object of this invention is to provide an improved method and apparatus for halting printing whenever an SCR failure occurs in the hammer drive circuits.

In accordance with one embodiment, the invention is employed in a line printer which employs successive time periods for effecting printing. During one such period or phase, input character data is compared with the location of moving type fingers (carried on an endless belt moving past the various column locations on a record medium) and the column location at which the various input characters are to be printed to produce a hammer firing signal. The hammer fire signals developed are applied to respective hammer firing SCR's to precondition these SCR's to be operated during the following drive phase. During the drive phase, drive voltage is applied to all hammer drive SCR cicuits simultaneously and those which have been conducting previously cause the energization of the respective hammer solenoid. This, in turn, results in the actuation of a type finger and impact on the record medium to produce a recorded character. During the third or commutation phase, the SCR drive voltage is removed and a negative voltage applied sufficient to cut off all SCR's and reset them. Thus, any desired subsequent firing depends upon further comparisons of input character data, type finger location and column information. To protect the hammer drive solenoids against overload, a separate, single pilot SCR is provided for causing the printer to be shut down in the event no firing pulses are being developed when power is applied to the drive bus for energizing the hammer solenoids. However, if with the establishment of a drive voltage on the drive bus feeding the hammer drive SCR's there is detected a hammer firing signal for any one of the respective hammers, the printer is enabled to continue printing.

BRIEF DESCRIPTION OF THE DRAWING

The features of the present invention believed to be novel are set forth with particularity in the appended claims. The function itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
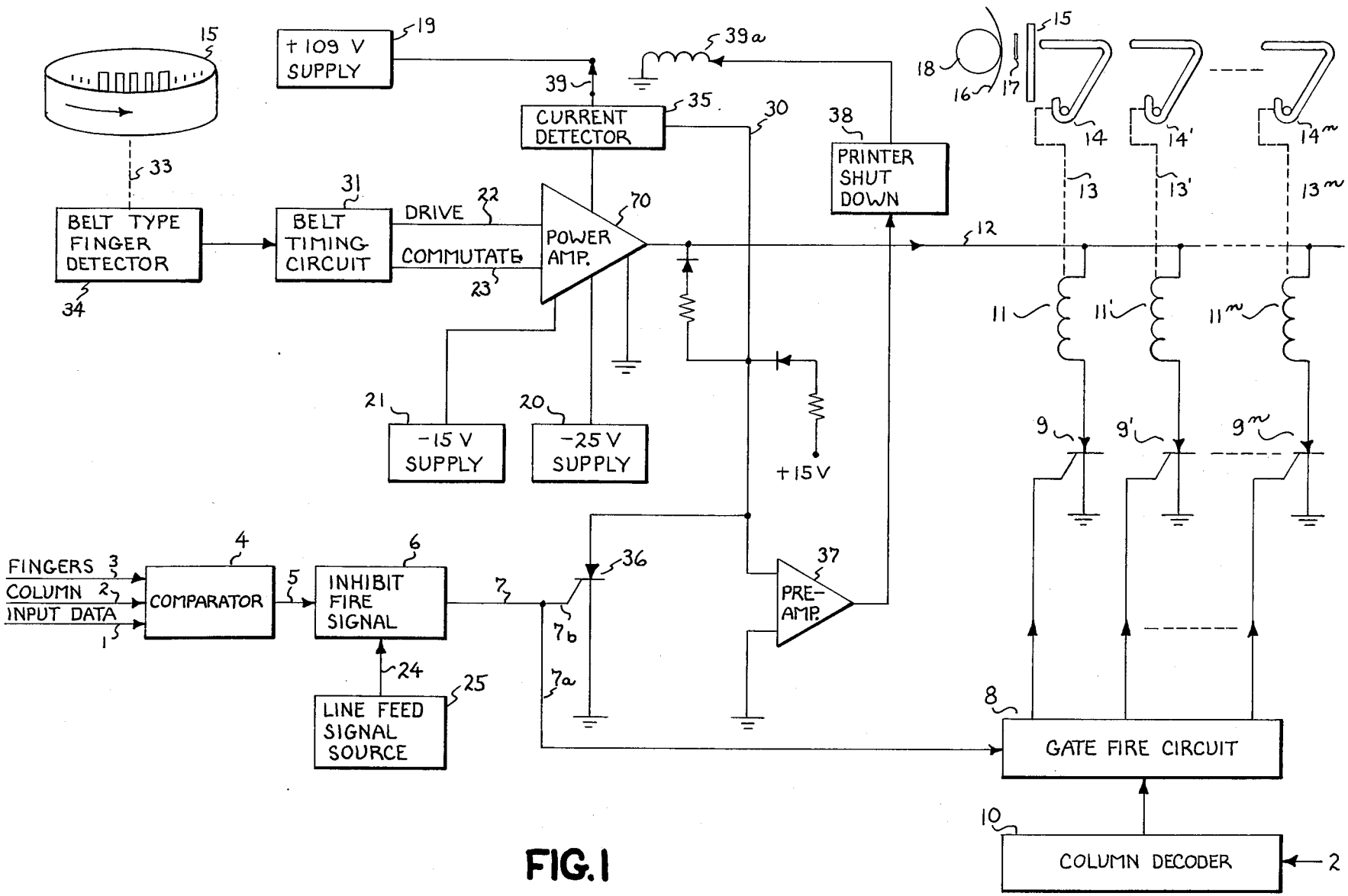
FIG. 1 illustrates in block diagram part schematic form the application of the present invention to a printer.

Referring to FIG. 1 there is shown in generalized block diagram form one embodiment of the invention as applied to a line printer or recorder. In such a printer or recorder the input data characters received from the source not shown are stored in a memory or other storage device. Generally this involves storing a line of input data characters at a time. The data received from the source is stored in memory in the sequence in which it is to be printed or recorded along a line on a record medium such as by impact printing through an inked ribbon onto paper. The printing or recording mechanism itself generally involves providing relative movement between recording characters or print type and the record medium. This may involve type carried by a drum or disk belt, etc. For purposes of this description it shall be assumed that printing is accomplished by flexible fingers carried by an endless belt wherein the printing type is located at one extremity of the finger. As the belt with fingers moves across a line on a record medium, hammers located along the line of printing are energized to selectively strike and drive the type bearing fingers to impact the paper through an inked ribbon. For further details of this type of type belt arrangement, reference may be made to U.S. Pat. No. 3,803,558 issued to Clifford M. Jones et al on Apr. 9, 1974 and assigned to a common assignee. In order to accomplish printing of type characters at the desired column locations where a moving belt or type is involved, certain data needs to be processed. In the particular embodiment selected for explaining the invention, this involves comparing the input data characters stored in memory and available on lead 1, the column at which the characters are to be printed as determined by the signals available on lead 2 and the instantaneous location of the moving belt and type fingers as established by the signals available on lead 3. Comparator 4 responds to the three pieces of data available on leads 1, 2 and 3 in accordance with a particular algorithm as explained in the aforementioned patent. It is sufficient to say that if the type finger is moving into a desired column location along the record medium and that it corresponds with the character to be printed at that position, an equal compare signal is produced on output lead 5. Assuming inhibit circuit 6 is not operated, this equal compare signal is applied over lead 7*a* to gate fire circuit 8. The function of the gate fire circuit 8 is to take each firing signal appearing on lead 7*a* and apply it to the SCR (silicon controlled rectifier) associated with the desired column location under the control of signals available from column decoder 10. Column decoder 10 responds to column information available on lead 2 to route the firing signal available on lead 7*a* to the SCR associated with the column signal being considered on lead 2. Power for the SCR circuits 9 is derived as follows. The cathode of each SCR is connected to ground and its gate connected to a respective output lead of the gate fire circuit 8. The anodes of each of the SCR 9's is coupled through a respective hammer solenoid 11 to a commmon drive bus 12. The hammer solenoids are shown mechanically linked, illustrated by dotted line 13, to a respective print hammer 14. When a solenoid is properly energized from the drive bus, its associated mechanical linkage 13 drives the associated hammer 14 against the type finger 15 positioned in front of it causing the finger to impact the record medium 16 througn an inked ribbon 17 against the platen 18. For purposes of simplicity, only one hammer arrangement is shown schematically in detail with an SCR 9. Voltage on the common drive bus 12 is established by a drive circuit comprising the 109 volt power supply 19, the power amplifier 70, the −25 volts supply 20 and the −15 volts supply 21 as well as the drive and commutate signals available on leads 22 and 23 respectively. The manner in which the drive and commutate signals are obtained and their function will be described shortly. Briefly speaking during the drive cycle, voltage on drive bus 12 is elevated from +3.5 volts to +80 volts. This +80 volts available on drive bus 12 is applied to all of the SCR 9's in the hammer bank through the respective solenoids 11. When SCR's are functioning properly, those SCR's previously preconditioned by conducting light current because they have been turned on by the firing signal applied from lead 7*a* through the gate fire circuit 8 during the compare cycle will conduct a relatively heavy predetermined current during the drive cycle and the others will not. Those SCR's that conduct will energize their respective solenoids 11 sufficiently to cause the associated hammers to be operated and cause printing. At the end of the drive cycle, the voltage on drive bus 12 is changed to −15 volts. This negative voltage is sufficient and necessary to turn off all those SCR 9's which had previously been conducting as well as the pilot SCR through a diode-resistor connection. This restores the hammer drive circuitry and pilot SCR to an initial condition preparatory to the start of another drive cycle.

Figure 2:
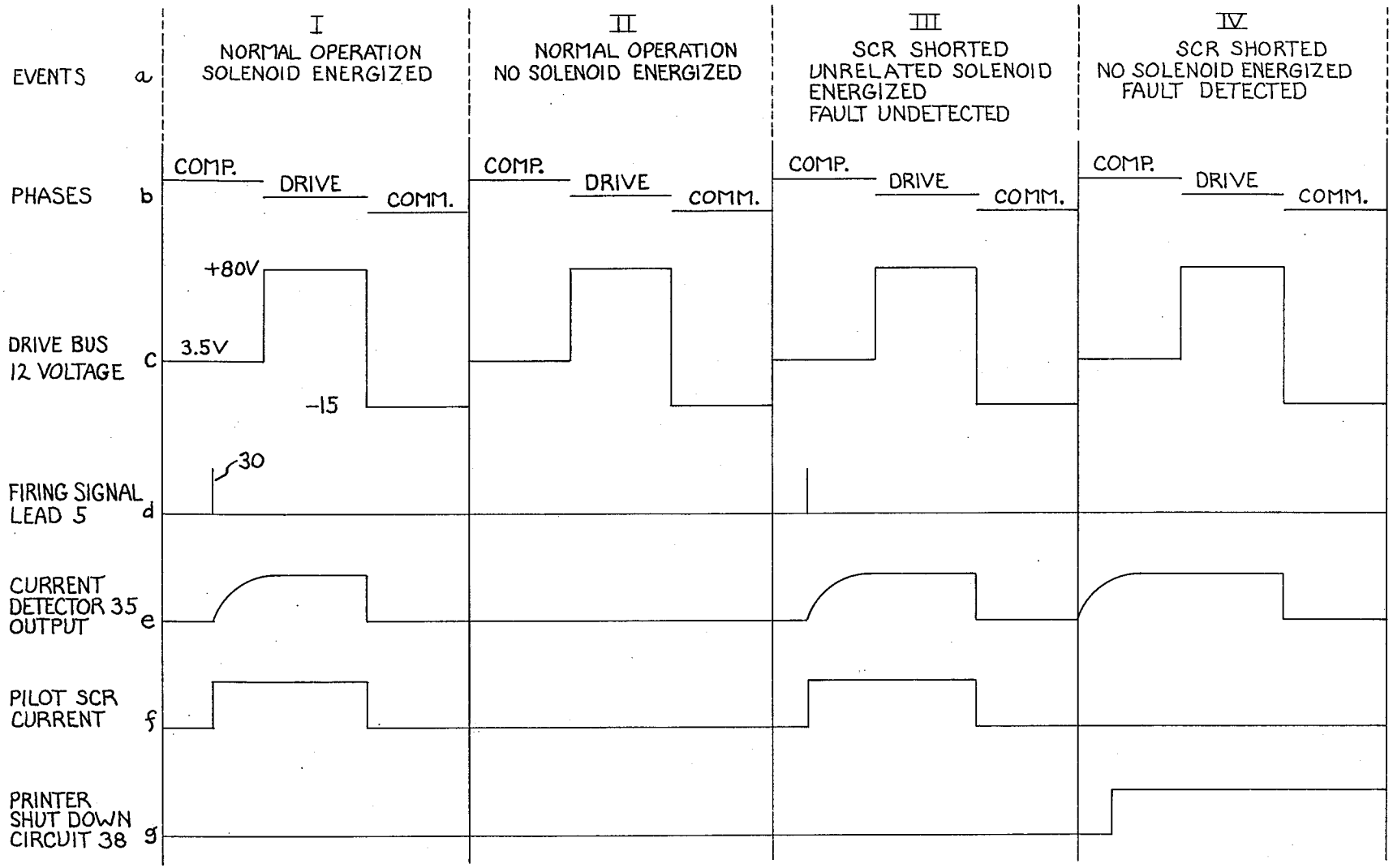
FIG. 2 illustrates graphically certain waveforms useful in explaining the operation of FIG. 1.

Referring to FIG. 2, there is shown graphically certain waveforms and timing signals useful in explaining the operation of the arrangement of FIG. 1. In each of the graphs 2*a* through 2*g* the signal level, signal occurrence or an event is plotted as an ordinate and the time is plotted as the abscissa. Four different sets of conditions are depicted in the graphs of FIG. 2. For purposes of simplicity, these conditions I through IV are shown condensed and following one another, although in practice they could occur otherwise. For example, graph *a* illustrates in I, the normal operation with solenoids energized, then II, normal operation with none of the solenoids energized, then III, an operation when an SCR has shorted but another, unrelated solenoid was properly energized (such that no failure was detected) and finally IV, a situation where an SCR has shorted, no other solenoids were energized and the SCR failure was detected. Graph *b* illustrates the predetermined compare, drive and commutate time segments of each printing operation. During the compare period, the signals applied to comparator 4 are compared to produce equal compare signals on lead 5. In the absence of a line feed signal being supplied over lead 24 from source 25, circuit 6 permits the equal compare signal developed on lead 5 to be supplied over lead 7*b* to the pilot SCR 36 to cause it to conduct and over lead 7*a* to gate fire circuit 8. Circuit 8 under control of column decoder 10 selects the particular SCR 9's preconditioned or to be turned on to conduct light current by this equal compare signal. This time segment is followed by a drive cycle when drive bus 12 is furnished with sufficient voltage to cause SCR's which had previously been turned on or preconditioned by equal compare or firing signals to conduct heavily and energize the associated solenoid sufficiently to cause printing to take place. The commutate segment corresponds to the time when a negative voltage is applied to bus 12 and hence to each of the hammer drive SCR's to turn them off. The various drive bus voltages developed on lead 12 are illustrated in graph *c* which shows how they change during each of the compare, drive and commutate segments. Graph *d* illustrates the situation when during condition I, an equal compare signal shown at 30 is developed on lead 5 indicating that the particular type finger 15 being considered by comparator 4 corresponds to the input data available on lead 1 and is to be printed at the column location indicated by the signal on lead 2.

The various timing segments representing the compare, drive and commutate periods are established by belt timing circuit 31 shown in FIG. 1. Type fingers 15 which are illustrated symbolically moving in the direction of the arrow are detected, as illustrated by the dotted line 33, by the belt finger detector 34. A common method employed for detecting type fingers utilizes a photoelectric circuit arrangement which operates on the light transmission properties of the type finger. For details of an appropriate circuit, reference may be made to U.S. Pat. No. 3,803,558 issued to Clifford M. Jones et al on Apr. 9, 1974 entitled "Print Selection System". Drive and commutate signals available on leads 22 and 23 occur successively and recurrently as shown in graph *b* of FIG. 2. The power amplifier 70 to be described operates on the basis of the two applied drive and commutate signals to provide an output of +80 volts and −15 volts, respectively, on bus 12. The period when both of these signals are absent is used to represent the compare period and power amplifier 70 operates to provide an output of +3.5 volts under this condition. The details of the operation of power amplifier 70 will be described shortly.

As mentioned, the amplifier 70 operates to produce a voltage of +80 volts on bus 12 during the drive time interval, a voltage of −15 volts during the commutate interval and a voltage of +3.5 volts during the compare interval. We have previously described how the SCR's operate during the drive interval to effect printing under normal conditions. The circuit arrangement of FIG. 1 operates such that when power amplifier 70 is supplying drive bus current, the current detected by current detector 35 is applied to the anode of pilot SCR 36 and to preamplifier 37. The cathode of SCR 36 is connected to ground and its gate electrode connected to lead 7. If the drive bus current is the result of an equal compare signal, a firing signal would appear on lead 7 which results in turning on one of the SCR 9's and the pilot SCR 36 which is energized from a +15 volt source. As a result of the firing signal being applied to the gate of pilot SCR 36, it conducts routing the detected current to ground. However, if the drive bus current is attributed solely to a failed or malfunctioned SCR, the pilot SCR would not have been turned on, and the current detector output would turn on the pre-amplifier 37 generating a fault signal. Pre-amplifier 37 essentially amplifies the detected drive bus current to a suitable level to cause the printer shutdown 38 to respond and energize relay coil 39*a* thereby opening relay contact 39. This removes the +109 volt supply from power amplifier 70, halting further printing.

An SCR which fails is detected during the drive period succeeding a previous compare period when no equal compare signal was developed. This is shown in IV. It is possible that an equal compare signal associated with a properly operating SCR would be generated while another SCR has failed. This is shown in III. This would not be detected as a fault. However, in any event, no equal compare signal will be generated during the line feed period occurring at the end of a line of printing. In a particular embodiment a line of characters will be printed in 225 milliseconds or less followed by a line feed period of approximately 25 milliseconds. The compare, drive and commutate periods were approximately .9, .7 and .6 milliseconds respectively. In a worst case condition, an SCR which shorts during an initial drive period would not be detected until the line feed period, some 225 milliseconds later. The hammer solenoids were designed to withstand continuous application of drive bus voltages for a minimum of one half second, or sufficient to accommodate this worst case condition. In FIG. 1 circuit 6 normally passes equal compare signals, which may comprise logic level signals, to lead 7. During a line feed period, source 25 supplies a signal over lead 24 to circuit 6 blocking or inhibiting the application of any equal compare signals to lead 7 for the period of the line feed. Upon termination of the line feed signal, circuit 6 would unblock permitting equal compare signals to be applied to lead 7. Circuits 31 and 70 continue to function during the line feed period but no printing takes place because of the absence of equal compare signals on lead 7.

Figure 3:
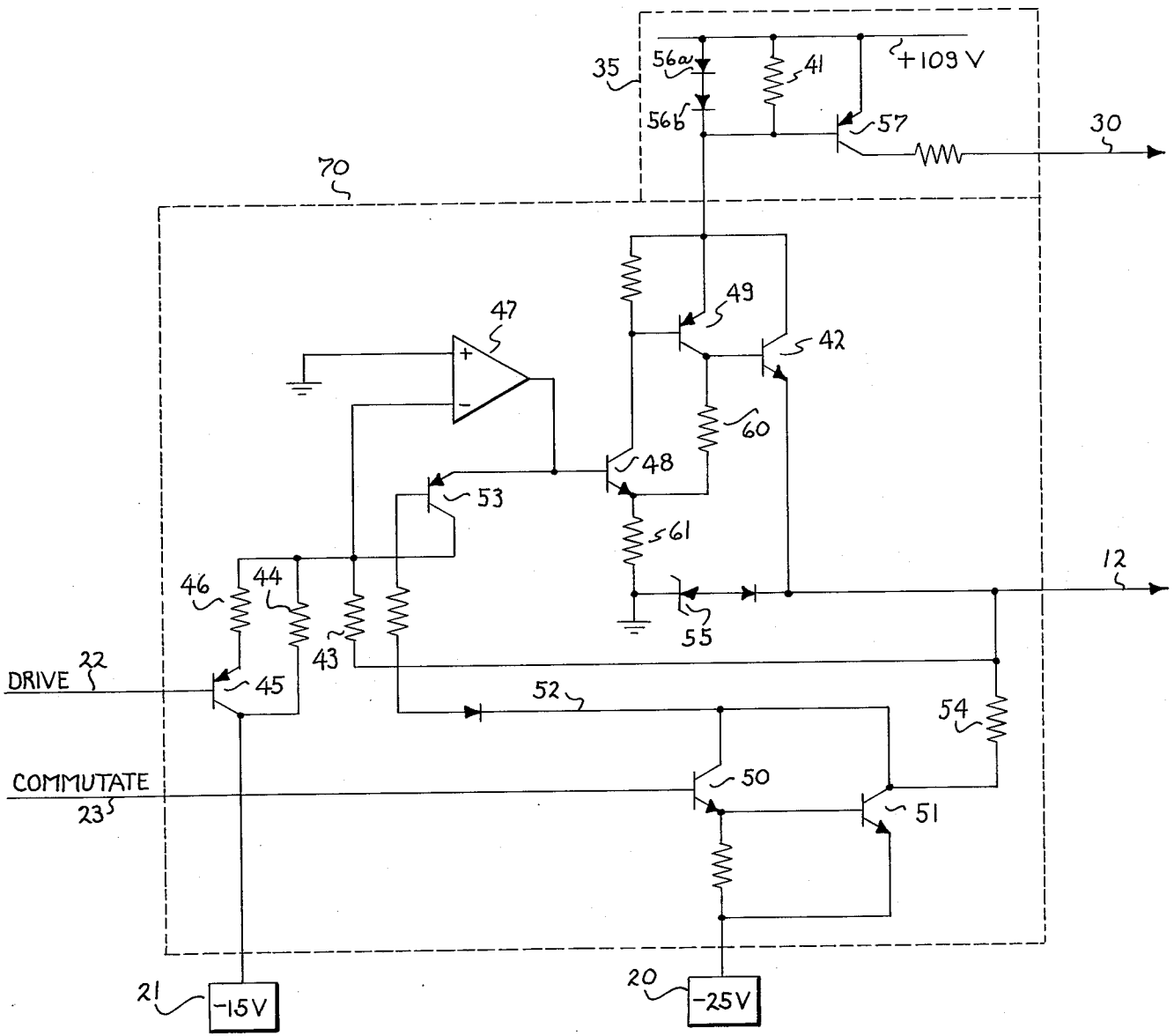
FIG. 3 illustrates in greater detail the functioning of selected circuits illustrated in FIG. 1.

Referring to FIG. 3, there is shown in greater detail the circuits constituting the current detector 35 and the power amplifier 70. Wherever possible common reference numerals have been retained, particularly with respect to the input and output leads to current detector 35 and power amplifier 70. Under the conditions where there is no input signal on leads 22 and 23, and no SCR 9's are operating, a small amount of current flows from source +109 volts through resistor 41, transistor 42, resistors 43 and 44 to −15 volts. This circuit then results in 3½ volts being developed on bus 12 with respect to ground. If a drive signal appears on lead 22 which may be a logic level signal, transistor 45 is turned on which couples the −15 volts from source 20 through resistor 46 to the inverting terminal of operational amplifier 47. Operational amplifier 47 has its non-inverting terminal connected to ground and its output terminal connected to the base of transistor 48. The circuit comprising transistors 48 and 49 and associated resistors 60 and 61 form an amplifier with a voltage gain of 11. The output of this amplifier is applied to the base of transistor 42 changing its resistance. This change results in the voltage on the drive bus 12 being driven to 80 volts with respect to ground. Under the circumstances where a commutate signal appears on lead 23 which may also be at logic levels, transistor 50 coupled to lead 23 at its base is turned on which causes transistor 51 to turn on which causes the pull-down bus 52 to be connected to the source of −25 volts. Pull-down bus 52 being connected to source 20 results in transistor 53 being turned on which causes operational amplifier 47 output to go to zero. The latter causes transistors 48, 49 and 42 to be turned off which, in turn, causes the resistor 54 to drive the voltage on bus 12 to −15 volts. Fifteen volts is established by the fact that whereas the source has an output voltage of −25, the 15 volt zener diode 55 clamps the output voltage at approximately 15 volts negative. Thus far, therefore, we have described the functioning of circuits 70 to produce the different voltages required for the compare, drive and commutate periods.

It should be noted that all output current for power amplifier 70 goes through the current detector 35 which will now be described. As previously mentioned, small currents associated with the lack of SCR conduction go through resistor 41. When the current flow through the detector increases as a result of SCR conduction to say the order of 6 tenths of an ampere, conduction now also begins through the diodes **56*a* and 56*b*. Transistor 57 is adapted to start conducting when the current flowing through the current detector approaches the order of 3 tenths of an ampere. This value is selected to be in excess of the normal leakage currents flowing in amplifier 70. Thus the current detector produces an output on lead 30 whenever the current flow through the current detector reaches 3 tenths of an ampere. This current indicates that a SCR 9** is conducting whether properly or improperly and as previously mentioned, the circuit described distinguishes between proper and improper SCR operation.

Summarizing therefore, in the absence of a conducting SCR, the output of current detector 35 is substantially zero and transistor 57 is non-conducting. If an SCR is conducting, this will result in a drive bus current greater than 3 tenths ampere. This causes transistor 57 to conduct producing approximately one half milliampere of current. This latter current is applied to preamplifier 37 to indicate a fault exists or it is shunted to ground through SCR 36 if no fault is detected, i.e. if the operation is normal.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

What I claim as new and desire to secure by Letters Patent of the United States is:

1. In a printer for printing characters corresponding to input signals wherein a plurality of type fingers are carried by an endless belt along a line of columns on a record medium and the column position of individual ones of said fingers is defined by finger signals, a plurality of print hammers each one positioned in front of a different one of said columns and operable for impacting type fingers passing before it, a plurality of hammer operating circuits each comprising a winding which is operatively associated with a respective one of said hammers, a logic circuit for selecting desired ones of said print hammers, said logic circuit comprising means responsive to input signals and said finger signals for preconditioning selected ones of said hammer operating circuits for operation when type fingers on said carrier specified by said input signals are positioned at the proper columns for printing, said last named means comprising means for preconditioning said hammer operating circuits in non-overlapping time periods during a signal compare period, means for simultaneously energizing all of said windings during a drive period following said signal compare period to cause only those hammer operating circuits which have been preconditioned during the previous signal compare period to conduct current sufficiently to cause their windings to operate their associated hammers and effect printing, and means responsive to current flow in any winding during a drive period in the absence of any preconditioned windings to block printing.

2. In a printer for printing characters corresponding to input signals wherein a plurality of printing characters are moved past a row of hammers along a line on a record medium, a respective hammer driver circuit associated with each of said hammers, means responsive to said input signals and the position of said moving printing characters relative to said hammers to provide firing signals when printing characters specified by said input signals are operatively positioned for printing by operation of said hammers, means for applying said firing signals to said hammer driver circuits only during a signal compare period for preconditioning said hammer driver circuits to operate selected one of said hammers and cause printing during a succeeding hammer drive period, means for providing a hammer driving voltage, means for applying said provided hammer driving voltage simultaneously to all of said driver circuits only during said drive period, said hammer driver circuits responsive to said application of voltage to operate only those hammers during said hammer drive period whose hammer driver circuits have been preconditioned during the immediately preceding signal compare period, means responsive to the operation of any of said hammer driver circuits during a drive period and the absence of a firing signal being produced in the immediately preceding signal compare period to block further printing by said printer.

3. In a printer for printing characters corresponding to input signals wherein a plurality of type fingers are moved by an endless belt along a line of columns on a record medium and a source provides finger signals indicative of the position of said moving fingers a plurality of print hammers each one positioned in front of a different one of said columns, a plurality of hammer electromagnets each one having a winding, a source of hammer drive voltage, a plurality of hammer drive SCR's each having their anode-cathode circuits coupled in a series circuit with a respective one of said windings, means comprising a common drive bus for coupling each of said series circuit in parallel across said source, means for causing said source to provide a first voltage on said drive bus during a signal compare period, a second voltage on said drive bus during a drive period and a third voltage during a commutate period wherein said periods follow one another in succession and occur recurrently, means coupled to said source for detecting current flow, a logic circuit for selecting desired ones of said print hammers, a source of hammer firing signals comprising means responsive to said input signals and said finger signals for providing hammer firing signals during said signal compare period when type fingers on said carrier specified by said input signals are positioned at the proper columns for printing, means for applying said hammer firing signals to the gates of the hammer drive SCR's associated with the hammers positioned at such proper columns, said hammer drive SCR's responsive during said signal compare period to said provided first voltage and said applied firing signals to conduct lightly, a pilot SCR, means for applying said hammer firing signals to the gate of said pilot SCR, said pilot SCR responsive during said signal compare period to an applied hammer firing signal to conduct, only said lightly conducting hammer drive SCR's responsive during said drive period to said provided second voltage to conduct heavily and energize their associated windings to operate their associated hammers and cause printing by impacting the type fingers positioned in front of said hammers, means responsive to at least one heavily conducting SCR and the absence of a conducting pilot SCR to produce a control signal, means responsive to said control signal for disabling said source from providing voltages, and means responsive to said conducting pilot SCR to block said control signal from disabling said source.

4. In a printer for printing characters corresponding to input signals wherein a plurality of printing characters are effectively moved along a line of columns on a record medium and the position of individual printing characters with respect to the column locations is defined by printing character signals, a plurality of print hammers each positioned in front of a respective column, a plurality of SCR hammer drive circuits each operatively associated with a different one of said hammers, a logic circuit for selecting said print hammers, said logic circuit comprising means responsive to input signals and said printing character signals for selectively preconditioning SCR hammer drive circuits during a signal compare period to operate their associated hammers during a following drive period, means for simultaneously energizing said hammer drive circuits during said drive period to cause only the preconditioned hammer drive circuits to develop a predetermined current for operating their associated hammers and effect printing, and means responsive during said drive period to the development of said predetermined current in the absence of any preconditioned drive circuits to block printing.

5. An arrangement according to claim 4 wherein said preconditioning means comprises means for causing said SCR hammer drive circuits to conduct a current having a value less than said predetermined current necessary to operate said hammers.

6. In a recorder for recording characters corresponding to input signals wherein a plurality of recording characters are effectively moved past a plurality of recording character activators along a line on a record medium, a respective recording driver circuit associated with each of said activators, means responsive to said input signals and the position of said recording characters relative to said activators to provide firing signals when recording characters specified by said input signals are operatively positioned for recording by operation of said activators, means for applying said firing signals to said driver circuits only during a signal compare period for preconditioning selected ones of said driver circuits to energize a selected one of said activators and cause recording during a succeeding drive period, means for providing an activator driving voltage, means for applying said provided voltage simultaneously to all of said recording driver circuits only during said drive period, said driver circuits responsive to said application of voltage to operate simultaneously only those activators during a drive period whose driver circuits have been preconditioned during the immediately preceding signal compare period, means responsive to the operation of any of said driver circuits during a drive period and the absence of a firing signal being produced in the immediately preceding signal compare period to block further recording by said recorder.

7. In a printer for printing characters corresponding to input signals wherein a plurality of printing characters are effectively moved along a line of columns on a record medium and the position of individual printing characters with respect to the column locations is defined by printing character signals, a plurality of printing character actuators each positioned in front of a respective column, a plurality of SCR actuator drive circuits operatively associated with said actuators, a logic circuit for selecting printing character actuators, said logic circuit comprising means responsive to said input signals and said printing character signals for selectively preconditioning SCR actuator drive circuits during a signal compare period to operate their associated actuator during a following drive period, means for energizing said actuator drive circuits during said drive period to cause only the preconditiond actuator drive circuits to develop sufficient current and operating their associated hammers and effect printing and means responsive during said drive period to the existence of said sufficient actuator drive circuit current in the absence of any preconditioned drive circuit to block printing.

8. An arrangement according to claim 7 further comprising a line feed signal source, means responsive to line feed signals from said line feed signal source for blocking the selective preconditioning of SCR actuator drive circuits during said signal compare period and hence to block the operation of their associated actuators during said following drive period.

* * * * *

UNITED STATES PATENT OFFICE

CERTIFICATE OF CORRECTION

Patent No. 3,998,152 Dated December 21, 1976

Inventor(s) A. C. Hupp

It is certified that error appears in the above-identified patent and that said Letters Patent are hereby corrected as shown below:

Col. 4, line 68, after "9's" insert -- to be --

Col. 5, line 1, cancel "to be"

Col. 8, line 37, after "fingers" insert -- , --

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*